US008136312B2

(12) United States Patent
Hallsten

(10) Patent No.: US 8,136,312 B2
(45) Date of Patent: Mar. 20, 2012

(54) FENCING FLOOR

(75) Inventor: Jeffrey A. Hallsten, Sacramento, CA (US)

(73) Assignee: Hallsten Corporation, Sacramento, CA (US)

( * ) Notice: Subject to any disclaimer, the term of this patent is extended or adjusted under 35 U.S.C. 154(b) by 546 days.

(21) Appl. No.: 11/880,166

(22) Filed: Jul. 19, 2007

(65) Prior Publication Data

US 2009/0020953 A1 Jan. 22, 2009

(51) Int. Cl.
*E04F 15/06* (2006.01)

(52) U.S. Cl. ..... 52/177; 52/588.1; 52/650.3

(58) Field of Classification Search ..... 52/177, 52/506.01, 506.05, 509, 403.1, 582.1, 592.1, 52/390, 377, 588.1, 650.3
See application file for complete search history.

(56) References Cited

U.S. PATENT DOCUMENTS

| | | | | | |
|---|---|---|---|---|---|
| 356,238 | A | * | 1/1887 | Balser | 52/592.1 |
| 2,955,687 | A | * | 10/1960 | Seim | 52/377 |
| 3,187,853 | A | * | 6/1965 | Glaser et al. | 52/377 |
| 3,555,762 | A | * | 1/1971 | Costanzo | 52/588.1 |
| 3,995,593 | A | * | 12/1976 | Bowser | 119/529 |
| 4,030,731 | A | * | 6/1977 | Delcayre | 463/47.1 |
| 4,329,739 | A | * | 5/1982 | Loebner | 362/153 |
| 4,737,764 | A | | 4/1988 | Harrison | |
| 4,947,595 | A | * | 8/1990 | Douds et al. | 52/177 |
| 4,973,505 | A | * | 11/1990 | Bielous | 428/44 |
| 5,095,412 | A | | 3/1992 | French | |
| 5,253,464 | A | * | 10/1993 | Nilsen | 52/508 |
| 5,617,677 | A | * | 4/1997 | Hallsten | 52/3 |
| 5,735,097 | A | * | 4/1998 | Cheyne | 52/489.1 |
| 6,018,925 | A | | 2/2000 | Biro | |
| 6,122,873 | A | * | 9/2000 | Randjelovic | 52/403.1 |
| 6,151,835 | A | * | 11/2000 | Hallsten | 52/5 |

(Continued)

FOREIGN PATENT DOCUMENTS

| | | |
|---|---|---|
| DE | 2022559 A1 | 11/1971 |
| GB | 2126106 A | 3/1984 |

OTHER PUBLICATIONS

PBT Hungary KFT, "44-PBT89 Aluminum Fencing Piste. Instructions for use and mounting", Internet citation, Jan. 1, 2010, p. 1, XP007916862, URL: shop.pbtfencing.com/fencing-equipment, retrieved on Jan. 25, 2011.

(Continued)

*Primary Examiner* — Brian Glessner
*Assistant Examiner* — James Buckle, Jr.
(74) *Attorney, Agent, or Firm* — Thomas M. Freiburger

(57) ABSTRACT

An aluminum floor for fencing has an improved friction surface with traction-enhancing grooves and is configured to reduce noise. Aluminum extrusions forming the floor define a flat surface but with series of parallel grooves separated by non-grooved spaces. In a preferred embodiment the grooves are essentially square cut. The grooves and spaces between the series of grooves are configured so as to allow sliding on the floor with the essentially flat soles of a user's fencing shoes when desired, but so as to grip the soles with significant friction when the shoe is heavily weighted causing the sole to deform down into the grooves. The fencing floor is intended to lie over an existing floor, as a series of easily connected floor sections. Rubbery sheet material is secured to the bottom of the fencing floor, preferably in transverse strips, directly beneath each joint and preferably at additional locations. When the fencing floor is used over a hard surface such as concrete, the rubber strips prevent the metallic clanging noise typical of aluminum fencing floors in use.

30 Claims, 4 Drawing Sheets

U.S. PATENT DOCUMENTS

| | | | | |
|---|---|---|---|---|
| 6,427,395 | B1 * | 8/2002 | Elsasser et al. | 52/181 |
| 6,505,444 | B1 * | 1/2003 | Johnson | 52/177 |
| 6,669,601 | B2 * | 12/2003 | Marciano | 482/12 |
| 6,966,155 | B2 * | 11/2005 | Nevison | 52/177 |
| 7,021,012 | B2 * | 4/2006 | Zeng et al. | 52/177 |
| 7,406,801 | B2 * | 8/2008 | Zeng et al. | 52/177 |
| 7,415,801 | B2 * | 8/2008 | Zeng et al. | 52/177 |
| 7,520,092 | B2 * | 4/2009 | Showers et al. | 52/177 |
| 2003/0140581 | A1 * | 7/2003 | Ludington | 52/177 |
| 2005/0055924 | A1 * | 3/2005 | Thomas | 52/390 |
| 2005/0284058 | A1 * | 12/2005 | Zeng et al. | 52/302.1 |
| 2006/0010804 | A1 * | 1/2006 | Gray et al. | 52/403.1 |
| 2007/0044416 | A1 * | 3/2007 | Van Dijk | 52/650.3 |

OTHER PUBLICATIONS

"Aluminum Fencing Pistes", Internet citation, Jan. 1, 2010, p. 1, XP007916863, URL: shop.pbtfencing.com/fencing-equipments/211.html, retrieved on Jan. 25, 2011.

* cited by examiner

FENCING FLOOR

BACKGROUND OF THE INVENTION

This invention concerns floors specifically for the sport of fencing, where floor sections of aluminum or other material typically are laid in a linear series to form an elongated relatively narrow floor. More specifically, the invention provides an improved friction surface in an extruded aluminum floor, and also several other improvements including reduced noise in a jointed floor during use.

The sport of fencing has seen increased popularity in this country in recent years, as well as in Europe, where it has a much longer tradition. Fencing is usually taught and practiced at local clubs, which hold competitions and participate in competitions locally, regionally, nationally and internationally. Fencing is a highly competitive sport that involves elements of speed, finesse, intelligence and strength. It has a growing number of passionate followers in the United States and is an Olympic sport.

There are three types of fencing: foil, epee and saber. In all three scoring is by valid touches on the opponent, but in foil and epee a touch is made by a thrust against the opponent, while saber involves slashing strokes. A plunger on the tip of the epee and the foil retracts with a valid touch and the score is indicated electronically. In saber fencing there is no plunger but a valid contact between a fencer's saber and the opponent's jacket or mask will electrically indicate the touch. Typically there are lights on or near the fencing floor that illuminate whenever a touch is made. In epee fencing the floor is conductive, so that when the floor is touched and the plunger depressed, no touch is electronically indicated.

The floor or piste on which the fencing competitors stand and perform is very important. The competing area is usually an elongated strip 1.5 meters wide. Although this can be simply laid out with border delineations on a wooden floor, wood is not the ideal surface. The surface should allow for controlled sliding of the foot during all the movements involved in the sport, but for gripping the sole of the foot firmly when full weight is placed upon the foot. At many clubs floor overlays are used, laid in one or more long strips over another floor which may be concrete, wood or other material.

Several manufacturers make floor overlays or "strips", including PBT of Hungary (see fencePBT.com) and MultLock, a Turkish company (see multlock-turkey.com). Both make strip aluminum fencing floors formed in one-half meter sections, with a 1.5 meter or 2 meter width. The extruded aluminum sections are formed with a friction surface, and in the case of both PBT and MultLock this high friction surface is achieved by parallel ridges extruded into the floor surface and extending in the lateral (transverse) direction. In both cases these ridges extend above, in upward relief, flat regions of the floor that occur at intervals, and the tips of the ridges are relatively sharp. As a result, the pliable sole of a fencing participant's shoe tends to be engaged too firmly by the sharp ridges, which deform the shoe sole material and push into the sole. This stops the shoe, and even with only partial weight on the shoe it will prevent the fencing participant from sliding the front foot when desired.

Sectioned aluminum fencing floors are often laid on concrete or other hard surfaces, and an issue is the clanging noise produced by a fencing competition on such a floor assembled of metal sections. The sections are hooked together but not bolted or otherwise tightly fastened, so there is give at joints, and the very rapid movements and quick footwork of fencing tend to cause aloud metallic noise that seems to be amplified in the acoustic conditions of some facilities.

It is an objective of the invention described below to provide an improved fencing floor, formed of connectable aluminum sections, with a surface that allows sliding when desired but which provides needed traction when the full weight of the user is placed upon a shoe, and also to make provision for reduction of the noise involved with a multi-section assembled metal fencing floor.

SUMMARY OF THE INVENTION

In the current invention a sectioned aluminum floor for fencing has an improved friction surface with traction-enhancing grooves. Aluminum extrusions forming the floor define a flat surface but with series of parallel grooves separated by non-grooved spaces. In a preferred embodiment the grooves are essentially square cut. The grooves and the spaces between the series of grooves are configured so as to allow sliding on the floor with the essentially flat soles of a user's fencing shoes when desired, but so as to grip the soles with significant traction when the shoe is heavily weighted causing the sole to deform down into the grooves. As in some previous products, this fencing floor is intended to lie over an existing floor, as a series of easily connected floor sections. Rubbery sheet material is secured to the bottom of the fencing floor, preferably in transverse strips, directly beneath each joint and preferably at additional locations. The rubber strips are spaced such that, for example, only a few inches of floor are unsupported by the rubber strips. When the fencing floor is used over a hard surface such as concrete, the rubber strips prevent the metallic clanging noise typical of aluminum fencing floors in use. In a preferred embodiment the rubbery strips, which can be the material PVC or other soft, extrudable polymers, are engaged in the bottom surface of the extruded aluminum sections by channels formed in the sections and a complementary shaped (T shaped) extension or ridge on each rubbery strip.

In a preferred form of the invention each floor section is comprised of a series of connected extruded planks that preferably engage with a hook-like connection in side by side relationship with one another and also are retained in position together by border or frame pieces that receive the edges of the planks in a close fitting channel (and preferably with adhesive), and with welds between some of the planks and the border or margin piece, at prescribed spacings.

Another preferred feature is that the border or margin strip has a channel at bottom that normally receives a rubber cushion strip but receives a threaded nut slidable through this channel, and this border strip is tapered downwardly at the outer edge. The nut is engaged by a machine screw at a location where the rubbery cushion is interrupted, to grounding lug. The grounding lug is crimped to a wire to carry the ground terminal of the electrically conductive floor. Thus, the same extruded channel providing for a slide-in rubber cushion also provides for the grounding lug.

A further feature in one preferred embodiment is a C-shaped channel formed at the outer edge of the border strip, formed during the extrusion process and opened outwardly. In this C-shaped channel can be installed an LED light tube. Wiring can also be contained in the same channel, just interior of the light tube. The LEDs of the light tube can be illuminated whenever a point is gained by proper fencing contact by one of the competitors.

Accordingly, primary objects of the invention are to improve the traction characteristic of an extruded metal fencing floor and to reduce or eliminate the metal clanging noise typical of such floors assembled in sections.

It is thus among the objects of the invention to reduce noise in a fencing floor assembled from a series of linked aluminum sections, and to provide a better surface for interaction with shoes of the users, particularly in an extruded aluminum, electrically-conductive floor. These and other objects, advantages and features of the invention will be apparent from the following description of a preferred embodiment, considered along with the accompanying drawings.

DESCRIPTION OF PREFERRED EMBODIMENTS

Figure 1:
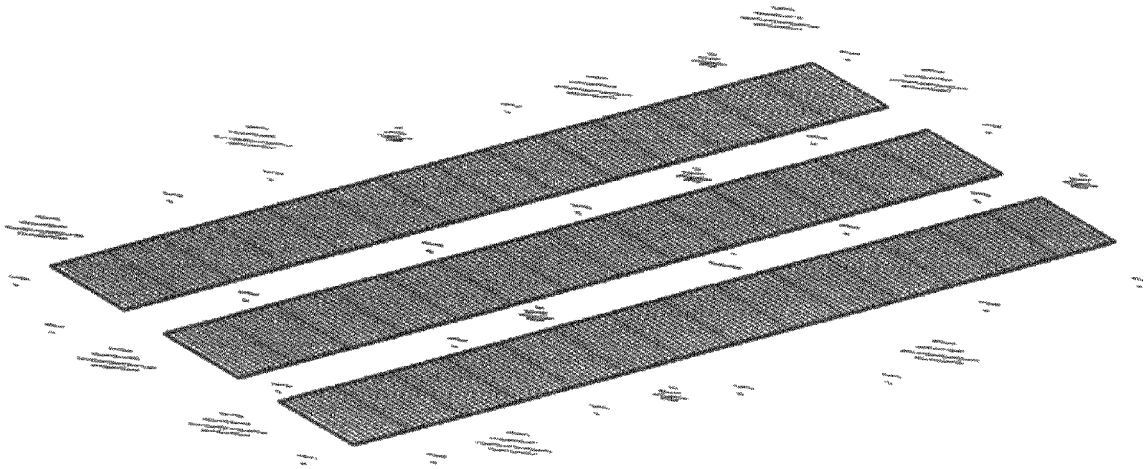
FIG. 1 is a perspective view showing a fencing floor of the invention, as laid over an existing floor.

In the drawings, FIG. 1 schematically shows a room to be used for fencing competition, and indicates several floor strips 10 for fencing. These floors, pursuant to rules, typically are 1.5 meter in width and of an elongated length as shown the official length being 14 meters. The fencing floors 10 are laid down over an existing floor 12, which may be wood, concrete, etc. In some cases the laid-down floor 10 may be wider, such as two meters wide, with a painted stripe along each edge, each 0.25 meter wide, to show the limits of the useable width of the floor.

The floor 10 of the invention is formed as a series of assembled sections that are conveniently laid in place to form the elongated fencing floor 10. These sections, which may each be one half or one meter in length, preferably include two end sections which have terminating edges. The edges at all four sides of the floor 10, in a preferred embodiment, are tapered so as to slope downwardly toward the existing floor 12.

Figure 2:
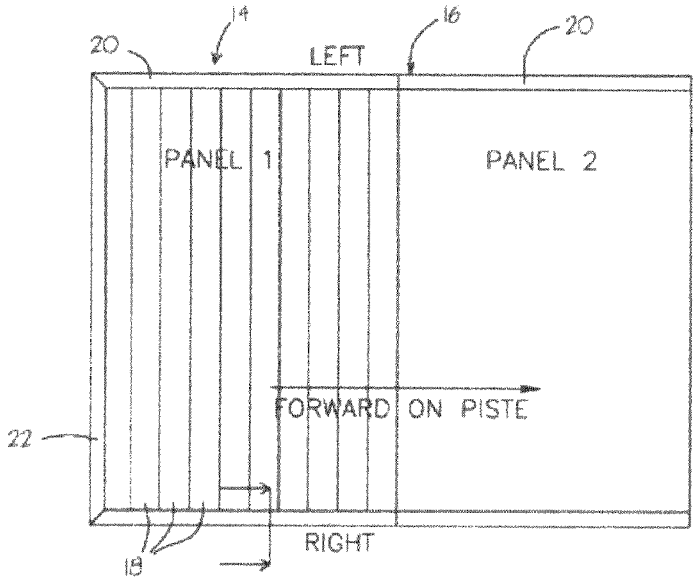
FIG. 2 is a plan view showing two floor sections of the floor system not in correct proportions of the invention, including an end section.

FIG. 2 shows two of the panels, an end panel 14 and a typical field panel 16, in plan view. Each panel 14, 16 in this preferred embodiment is made up of a series of assembled, parallel, side-by-side floor planks 18. These planks 18 are connected together and are retained in place by margin or frame strips 20 (sides) and 22 (ends of end panels 14). All of the planks and strips 20, 22 preferably are aluminum extrusions.

Figure 3:
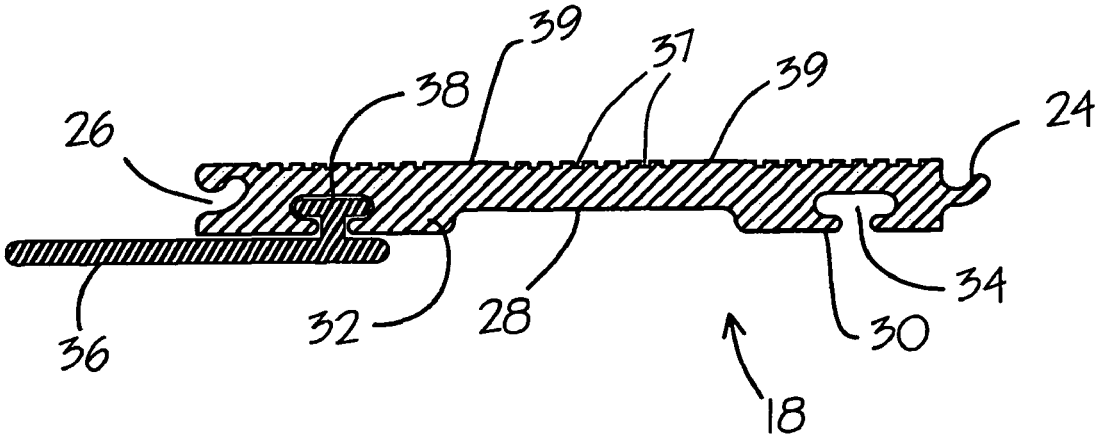
FIG. 3 is a sectional view showing a preferred form of extruded plank for the floor section, one of a series of planks secured together to form a section or panel.

FIG. 3 is a cross section view showing a single plank 18 of the fencing floor and of a panel 14 or 16 illustrated in FIG. 2. The cross section plane is longitudinal with respect to the length of the fencing floor, thus crossing transversely through the length of a plank 18. The extruded metal (preferably aluminum) piece 18 has a curving extension or protrusion 24 at one end, extending through the length of the extrusion. This connects in a hooking relationship into a complementarily shaped socket 26 of a succeeding plank, also shown at the opposite of the illustrated plank 18. The thickness of the metal may be about 6 mm in a center section 28 and about 9 mm at floor-engaging bosses or bases 30 at one end and 32 at the opposite end.

As illustrated, the plank 18 has, at each of the bosses 30, 32, a channel 34 which slidingly receives a rubbery cushion sheet or strip 36, which can be soft, extrudable PVC. This sheet or strip may be, for example, about 2 to 3 mm in thickness. It has a generally T-shaped ridge or flange 38 integrally formed at its upper side, sized or configured to slide into the complementarily shaped channel 34, with little friction. These strips or sheets 36 frictionally engage the fixed floor and cushion the engagement of the panels or sections against the floor, which may be of concrete or wood, and prevent noise at joints between sections or between the metal and the floor as the fencing floor is used. The planks 18 preferably fit together with relatively close tolerance at the joints that are formed by the curving extension ridges 24 fitting into the curved channels 26, and under each joint between panels or sections 16 is a strip of the rubber material 36. In a preferred implementation of the invention the rubbery cushioning strips 36 are located at every joint between planks 18, so that in the case of plank widths of 10 cm and section lengths of one meter, there are ten of the rubbery cushioning strips in each section or panel. The strips could take alternative configurations or could be employed less frequently (at greater spacing) if desired. Larger sheets could be used, and each sheet could connect with more than one of the extruded channels 34 of the planks.

FIG. 3 shows that the planks 18 have, in a preferred embodiment, grooves 37 formed down into the surface. These series of grooves 37 in parallel groove portions extend lengthwise of each plank 18, but transversely relative to the length of the fencing floor 10. It is important that these grooves are formed down into the top surface of the plank, the top surface being defined by non-grooved spaces 39 between each series of grooves 37, and also by the plank surface immediately between adjacent grooves 37. This flat surface defines a plane that includes the non-grooved spaces 39 and the plank surface immediately between adjacent grooves. Prior fencing floors have included ridges which extend upwardly from the surface of the floor, and these can cause problems as described above. The system of grooves 37 and spaces 39 between grooves as encompassed by the invention solves this problem as described above. In a preferred embodiment the total surface area occupied by or defined by the grooves themselves is about 31% of the total floor surface. More broadly, it is preferred that the total area occupied by the recesses or grooves is about 25% to 30% of the floor surface, but more preferably the recessed area is within 2% to 4% of the 31% preferred figure noted above.

As seen in the drawings, the grooves 37 are in series. Each series 37*a*, which may have about eight recesses, in a preferred embodiment, spans about 12 to 25 mm along the floor as measured in the length direction of the floor, and preferably each space 39 between series of grooves spans about 7 to 15 mm as measured in the length direction of the floor. More preferably each series 37 of grooves recesses is about 22 mm wide and each space 39 between series of grooves spans about 11 mm. Each groove or recess 37 may be a little over 1 mm in width, preferably in the range of about 1.25 mm to 1.3 mm in width and may be approximately 0.5 mm in depth (preferably about 0.3 to 0.9 mm depth). As explained above, these recesses or grooves enhance traction in a surface which is otherwise flat and allows the fencing user to slide forward with his front foot.

Each panel or section 14 has, via the planks, a hooked flange or protrusion 24 at one end (male) and a hooked channel or socket (female) 26 at its opposite end. To assemble the sections the male end of one section is angled downwardly to assemble it into the adjacent, already-laid section.

Figure 4:
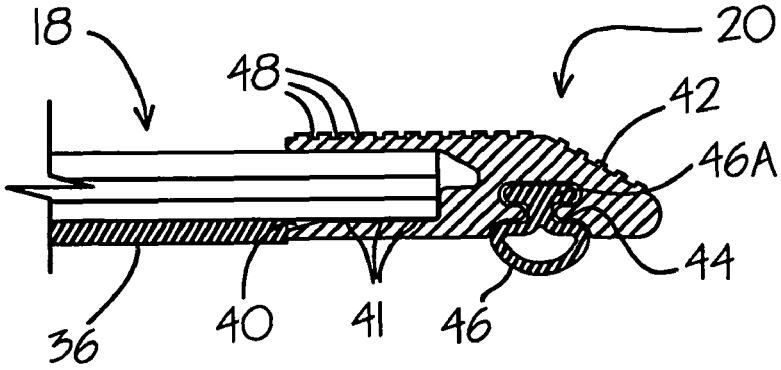
FIG. 4 is a sectional view showing a frame or margin strip, an extruded metal piece that frames the floor section and retains the planks in position.

FIG. 4, a cross section looking in the longitudinal direction of the floor taken along the line 4-4 in FIG. 2, shows the manner in which the frame or border pieces 20 firmly engage with the edges of the planks 18. The ends of these planks extend into a channel 40 preferably in a tight, interference fit, and they are also secured by an effective metal adhesive such as SikaFlex 1A polyurethane adhesive manufactured by Sika Corp. of Lyndhurst, N.J. They may extend into the channel about 1.5 to 3 cm, for example, and most preferably about 2 cm. To increase the firmness of the grip between the frame piece 20 and the planks, the channel 40 may include "teeth" or ridges 41 that extend lengthwise of the border piece 20 and are somewhat malleable and deformable when the border piece 20 is forced over the series of connected planks. The outer edge of the frame or margin connector piece 20 is tapered downwardly toward the outside at 42, to form a transition up from the fixed floor onto the platform of the fencing floor. As also shown in FIG. 4, the margin or border piece 20 is extruded with a channel 44 in the bottom, near the outside edge, to receive a cushioning elastomeric strip 46. This rubber-like strip 46, retained in the channel 44 preferably by a T shape upper extension 46*a* as shown, provides, along with the rubbery elastomeric strips 36 connected to the bottoms of the planks and extending laterally, positive friction engagement with the floor and cushioning that both gives a better feeling to the floor surface and reduces or eliminates the clanging of metal against metal when the floor is in use.

FIG. 4 also shows that the top and inclined surfaces of the frame or border piece 20 preferably have grooves 48 formed down into the surface in the extruding process. These provide good traction for persons entering or leaving the fencing floor and for participants who may step near the edge of the floor.

Figure 5:
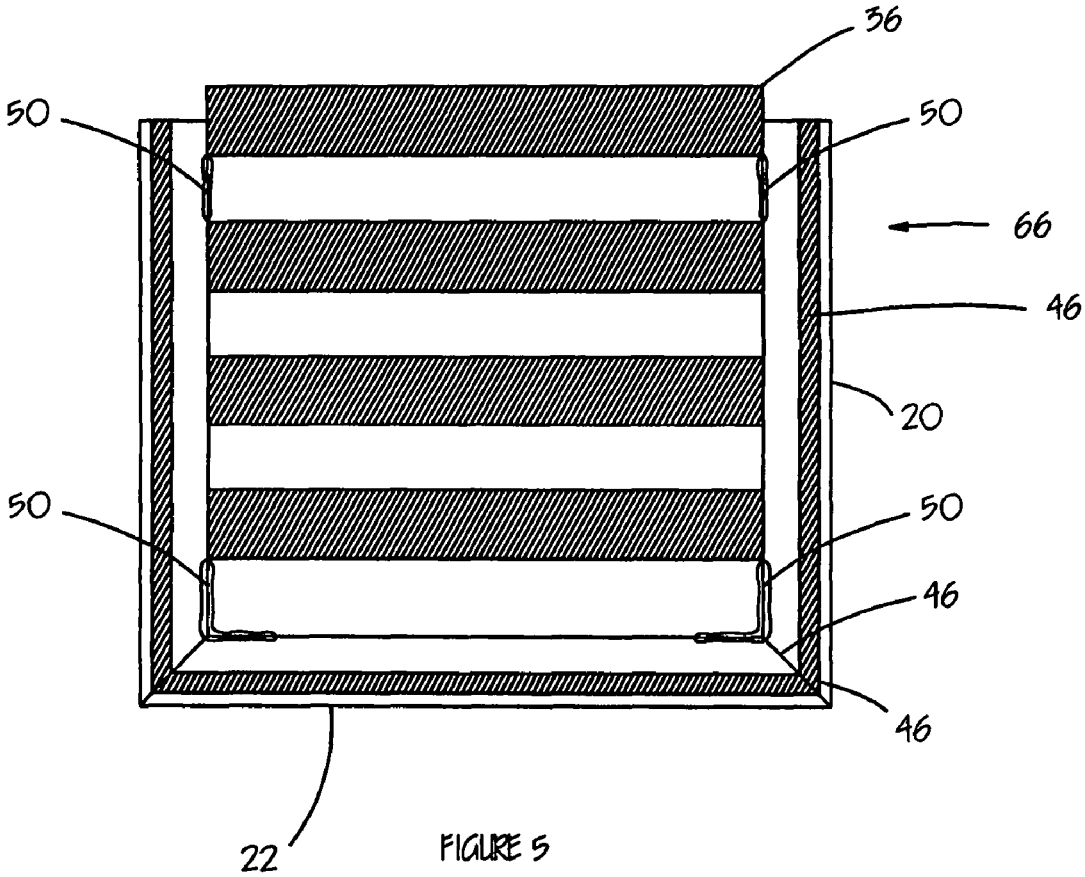
FIG. 5 is a view showing the underside of a floor section, including rubber strips secured to the extruded metal members of the floor section.

The frame or margin piece 20 therefore retain the edges of the planks very firmly, in a tight fit with the channel 40. However, as shown in FIG. 5, some of the planks 18 preferably are fixed as by welding to the border strip 20 at the bottom side. FIG. 5 indicates welds 50, which can be applied only at the ends of a section or panel (which may be one half or one meter long), assuring that the planks cannot separate or work their way loose. FIG. 5 also shows the rubbery strips 36 retained to the bottom side of the panel, which can be at intervals of one strip for each plank. Also, the drawing shows the rubbery cushion strip 46 which is fitted into the margin or frame piece 20 as shown in FIG. 4. FIG. 5 illustrates one of the two end panels or sections, and shows that the border or frame pieces 20, 22 can be mitered together at corners 52, and the rubbery margin-connected strips 46 may also be mitered or can simply be abutted together at corners.

Figure 6:
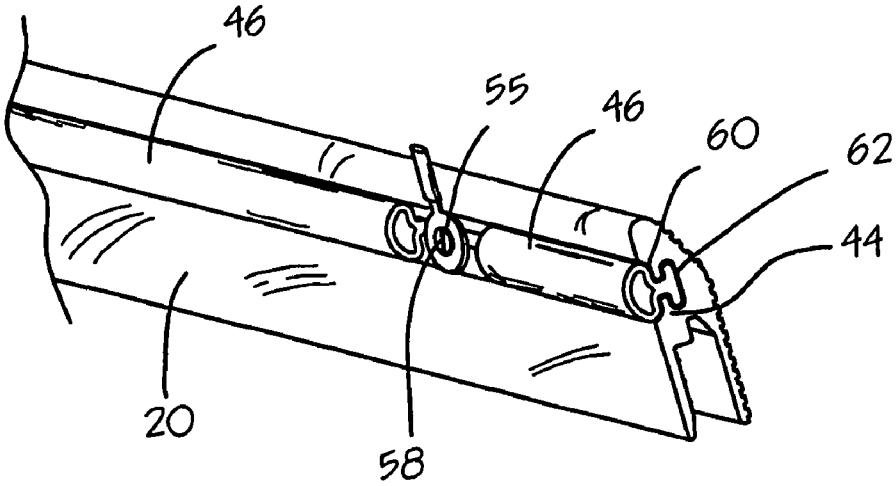
FIG. 6 is a bottom perspective view showing a grounding lug and the manner of its securement to a frame piece of a floor section.

The fencing floor of the invention can advantageously include several additional features. FIG. 6 shows how the margin or border piece 20 or 22 can be used to secure a grounding lug 55 to the metal floor. The floor should be grounded for scoring purposes, for epee. The grounding lug 55 is placed in an interruption of the rubbery cushion piece 46, with a machine screw 58 passing through the grounding lug's aperture and down through the slot 60 that is part of the extruded channel 44. A nut (not seen in the drawing) is assembled into the deeper slot 62 at the interior side of the channel 44, to the position where it can be engaged by the machine screw 58.

Figure 7:
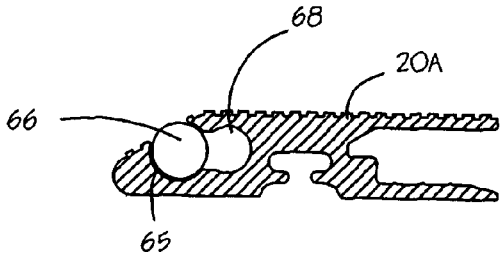
FIG. 7 is a sectional view showing a modification of the extruded margin strip for accommodating an LED light tube.

FIG. 7 shows a modified form of border or frame strip 20*a*. It is similar to the border strip 20 shown in FIGS. 4 and 6, but has a C-shaped cavity 65 at the outside edge, to retain an LED light tube 66. Thus, the entire border of the fencing floor can be provided with such an LED light tube, snapped into the cavity 65 and wired so as to be capable of illumination to indicate when a point is scored. If desired, the cavity 65 can have a further recess 68 to run wiring, so that the wiring can be laid first into the inner recess or cavity 68, then the LED light tube 66 can be snapped into the outer recess 65, capturing the wiring in place.

Figure 8:
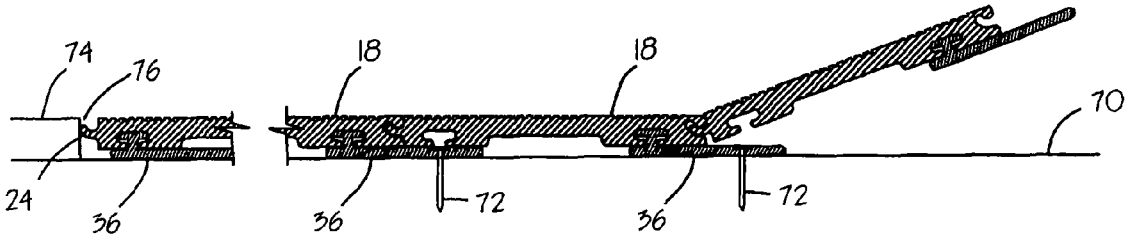
FIG. 8 is a side elevation view in section showing a recessed installation of a fencing floor.

It is also possible to install a floor according to the invention without a border strip 20, 22, as a recessed installation in an existing floor. This can be in new construction or in an existing floor. If, for example, an existing floor has wood flooring over some type of subfloor, the planks 18 can be installed in a recess formed where the flooring is removed. The flooring can be cut out of an existing floor, or in a new installation an appropriately-sized recess can be left for this purpose. FIG. 8 shows one method for laying a fencing floor of the invention in such a recess, so as to provide an inlaid fencing floor. The planks 18 are shown with the rubbery cushion strips 36 supporting them against a subfloor or underfloor 70. In the case this underfloor is of wood, the rubbery strips 36 can be progressively installed by using nails 72 (concrete nails could be used in a concrete floor). The existing finished floor is shown at 74, and has been cut out as indicated at 76. A portion of the plank 18 on the left is shown cut away and foreshortened.

The installation of FIG. 8 starts with the plank that would be left-most as seen in the drawing, the planks being arranged with their length extending into the page, the widths being shown in cross section in the drawing. The left-most plank 18 is first laid down, with a rubbery cushion strip 36 or a portion secured to that side of the plank. This first strip 36 can be secured by gluing or by nails without being secured to the plank itself. If desired the hook end 24 at the left side of this plank can be removed prior to installation; however, this hook end 24 could be used to anchor the left side of the plank, if a groove (not shown) were formed in the end 76 of the floor 74 to receive this hook end, avoiding the need for any adhesive attachment.

When the first plank 18 is lowered into place, it includes a rubbery cushion strip 36 at its right side, as shown, fitted into the metal extrusion as the figure reveals. When the plank is down, the rubbery strip extends cut to the right as seen in the drawing, and this extending end is nailed down with a series of nails 72. Next, the next succeeding plank 18 is laid down, hooked onto the installed plank, with a cushion strip 36 already secured on its right side. This outer end is swung down onto the subfloor 70, and again the nails are installed through the outwardly extending cushioning strip. This process continues until the floor has been fully installed across the recess. For the last plank (which would be to the right in FIG. 8), the rubbery strip can be secured to the subfloor by adhesive. It should also be understood that all rubbery strips can be secured to the floor by adhesive, if desired, although fasteners generally are preferred.

In this installation the planks 18 are the full width of the fencing floor, i.e. preferably 1.5 meter (or 2 meters as noted above).

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A fencing floor laid on and overlying a fixed floor, comprising:

extruded metal planks extending widthwise through the fencing floor, the planks having a top side and a bottom side and being connected side by side and retained in place with a metal border strip that engages the ends of the extruded planks, the planks and retaining border strips being put together in a linear series of sections of a common width and of selected length, with connections on ends of sections providing for connection to adjacent sections such that the sections cannot pull apart as laid on the fixed floor, elastomeric sheet material secured at the bottom of the metal planks of the fencing floor at least at all connections where sections are secured together, the elastomeric sheet material lying against the fixed floor, the top sides of the metal planks defining a flat surface comprising parallel groove portions with series of parallel grooves formed down into the surface and extending the length of the planks to provide for friction with a user's shoe soles, with non-grooved flat spaces between grooves and between series of the parallel grooves and extending the length of the metal planks to allow sliding advance of a user's shoe unhindered by any structure extending above the flat surface, and wherein the non-grooved flat spaces between grooves in the parallel groove portions and the non-grooved flat spaces between series of grooves are within a single plane defining said flat surface, and the fencing floor having an elongated length much greater than the width of the sections.

2. A fencing floor as in claim 1, wherein the extruded metal planks are aluminum.

3. A fencing floor as in claim 2, wherein the grooves are essentially square cut.

4. A fencing floor as in claim 2, wherein each series of grooves spans about 12-25 mm as measured in the length direction of the floor, and each space between series of grooves spans about 7-15 mm wide as measured in the length direction of the floor.

5. A fencing floor as in claim 4, wherein each series of grooves is about 22 mm wide and each space between series of grooves is about 11 mm wide.

6. A fencing floor as in claim 2, wherein, through the length of the floor, the series of grooves comprise a total of about two-thirds of the length and spaces comprise a total of about one-third of the length.

7. A fencing floor as in claim 2, wherein total area defined by the grooves themselves is about 31% of the floor surface.

8. A fencing floor as in claim 2, wherein total area defined by the grooves themselves is, about 25% to 40% of the floor surface.

9. A fencing floor as in claim 2, wherein the spaces between series of grooves are about one-half as wide as each series of grooves, in the length direction of the assembled floor.

10. A fencing floor as in claim 1, wherein the elastomeric sheet material comprises elastomeric strips that extend transversely relative to the length of the fencing floor.

11. A fencing floor as in claim 10, wherein the elastomeric strips are spaced apart to define a space of about 2 to 6 cm between strips.

12. A fencing floor as in claim 11, wherein the space between strips is about 4 cm.

13. A fencing floor as in claim 10, wherein the strips are secured to the bottom of the fencing floor sections by extruded channels in the metal planks, within which generally T-shaped ridges on the upper surface of the strips are assembled by laterally sliding them into the channels.

14. A fencing floor as in claim 1, wherein the grooves are essentially square cut and wherein each has a width between about 1 mm and 1.5 mm.

15. A fencing floor as in claim 1, wherein the metal border strip comprises an extruded metal strip having a recess engaging over the ends of the extruded metal planks at sides of the fencing floor and over side edges of the extruded metal planks at ends of the fencing floor.

16. A fencing floor as in claim 15, wherein the extruded metal border strips include, at an outer side of each border strip, an extruded, generally C-shaped recess or cavity open at an outside edge, sized to receive an LED light tube by snap-in connection.

17. A fencing floor as in claim 16, further including an inner recess or cavity extruded in the metal border strip, just inward of and open to the outer recess, positioned to receive wiring.

18. A fencing floor as in claim 1, wherein the metal border strip comprises an extruded metal strip engaging over the ends of the extruded metal planks, each border strip having an extruded channel at a bottom side for receiving an elastomeric cushioning strip protruding from the bottom of the border strip to cushion the metal strips against the floor.

19. A fencing floor as in claim 18, wherein the elastomeric cushioning strip at the bottom side of at least one of the border strips has an interruption, and in the interruption a grounding lug is screwed into the metal of the border strip.

20. A fencing floor installed on and overlying a fixed floor or subfloor, comprising:

extruded metal planks extending widthwise through the fencing floor, the planks having a top side and a bottom side and being connected side by side at plank junctions, elastomeric sheet material secured at the bottom of the metal planks of the fencing floor at least at some plank junctions, contacting the floor or subfloor and isolating the planks from the floor or subfloor, the top sides of the metal planks defining a flat surface comprising parallel groove portions with series of parallel grooves formed down into the surface and extending the length of the planks to provide for friction with a user's shoe soles, with non-grooved flat spaces between grooves and between series of the parallel grooves and extending the length of the metal planks to allow sliding advance of a user's shoe unhindered by any structure extending above the flat surface, and wherein the non-grooved flat spaces between grooves in the parallel groove portions and the non-grooved flat spaces between series of grooves are within a single plane defining said flat surface, and the fencing floor having an elongated length much greater than the width of the sections.

21. A fencing floor as in claim 20, installed as an inset in a floor, the fencing floor being set into a recess in the floor so as to be approximately flush with the floor surrounding the fencing floor.

22. A fencing floor as in claim 21, wherein a strip of the elastomeric sheet material is positioned under each plank junction.

23. A fencing floor as in claim 22, wherein the elastomeric strips are secured down to a subfloor by nails, the nails being, at each plank junction, under one plank of the junction and not the other.

24. A fencing floor as in claim 22, wherein the strips of elastomeric material are secured to a subfloor in the recess, and each strip of elastomeric material having an extruded and elongated projection which slidingly fits in a complementarily shaped recess in the bottom side of a plank so as to capture the projection, the planks being metal extrusions.

25. A fencing floor as in claim 20, wherein the elastomeric sheet material comprises elastomeric strips that extend transversely relative to the length of the fencing floor, and wherein the strips are secured to the bottom of the planks by extruded channels in the metal planks, within which generally T-shaped ridges on the upper surface of the strips are assembled by laterally sliding them into the channels.

26. A fencing floor as in claim 20, wherein the extruded metal planks are aluminum.

27. A fencing floor as in claim 26, wherein the grooves are essentially square cut.

28. A fencing floor as in claim 26, wherein each series of grooves spans about 12-25 mm as measured in the length direction of the floor, and each space between series of grooves spans about 7-15 mm wide as measured in the length direction of the floor.

29. A fencing floor as in claim 20, with a width of 1.5 meter and a length of 14 meters.

30. A fencing floor as in claim 1, with a width of 1.5 meter and a length of 14 meters.

* * * * *